United States Patent [19]

Draheim et al.

[11] Patent Number: 5,072,464

[45] Date of Patent: Dec. 17, 1991

[54] CRIB DROPSIDE INCLUDING LATCH MECHANISM

[75] Inventors: Harvey J. Draheim, Weyauwega; Glenn T. Charlson, New London; John L. Beiswenger, Salem; Merlin A. Brunner, New London, all of Wis.

[73] Assignee: Simmons Juvenile Products Company, Inc., New London, Wis.

[21] Appl. No.: 118,749

[22] Filed: Nov. 6, 1987

[51] Int. Cl.[5] ..... A47D 7/00

[52] U.S. Cl. ..... 5/93.1; 5/100; 292/38

[58] Field of Search ..... 5/93.1, 100; 292/38, 292/40, 171, 173, 153

[56] References Cited

U.S. PATENT DOCUMENTS

| | | | |
|---|---|---|---|
| 417,589 | 12/1889 | Rose | 292/40 |
| 1,615,120 | 1/1927 | Fischer | 292/38 |
| 2,564,386 | 8/1951 | Webb | 5/93 R |
| 4,395,892 | 8/1983 | Remington | 292/38 X |
| 4,703,524 | 11/1987 | Brunner et al. | 5/93 R |
| 4,768,243 | 9/1988 | Waples | 5/100 |

FOREIGN PATENT DOCUMENTS

| | | | |
|---|---|---|---|
| 2257744 | 6/1974 | Fed. Rep. of Germany | 292/38 |
| 2298667 | 9/1976 | France | 292/38 |
| 25982 | of 1912 | United Kingdom | 5/100 |

*Primary Examiner*—Alvin C. Chin-Shue

*Attorney, Agent, or Firm*—Hoffman & Baron

[57] ABSTRACT

A crib dropside is provided which includes a double-acting latch mechanism for releasing the dropside from a locked position. The dropside includes an upper rail having a groove extending within the front surface thereof. The grove extends for the entire length of the rail. A pair of spring-loaded locking pins are mounted to each end of the rail. A cable extends within the groove and is secured at each end to the locking pins, the center of the cable being secured to a slide member within the latch mechanism. The dropside is slidably mounted to a pair of tracks, the tracks including openings for receiving the locking pins. Actuation of the latch mechanism causes the pins to be withdrawn from the openings. Additional openings are provided within the tracks for allowing a mattress support and crib stabilizer bars to be mounted thereto.

10 Claims, 8 Drawing Sheets

CRIB DROPSIDE INCLUDING LATCH MECHANISM

BACKGROUND OF THE INVENTION

1. Field of the Invention

The field of the invention concerns crib constructions and latch mechanisms therefor.

2. Brief Description of the Prior Art

Crib dropsides are today generally releasable from a locked position by means of a foot operated lever positioned beneath the crib. While this construction has proven to be safe and effective, it is not particularly convenient, particularly if an infant is being held at the same time.

A number of hand-actuated latch mechanisms have been proposed, including those shown in U.S. Pat. Nos. 1,242,509 and 1,705,851. The former construction provides a pair of thin, slidable rods within a hollow bar which defines the top rail of the dropside. A spring urges the rods in opposite directions and into locking engagement with a pair of vertical rails. An actuating mechanism including a pair of opposing grips allows the rods to be moved toward each other and out of engagement with the vertical rails. The '851 patent discloses a mechanism which operates in a similar manner.

SUMMARY OF THE INVENTION

A dropside mechanism is provided by the invention which allows the dropside to be moved to a desired position using only one hand. A double-acting latch mechanism is employed to prevent the dropside from being inadvertently unlocked.

In accordance with a first embodiment of the invention, a dropside is provided which includes an upper rail having a groove defined in at least one side thereof. A cable is positioned within the groove, the opposite ends of which extend toward the ends of the rail. Each cable end is secured to a pin which is used for locking the dropside at a selected height to a pair of vertical rails. A latch mechanism is mounted to the upper rail and is secured to the cable between the two ends thereof. Operation of the latch mechanism causes both ends of the cable to be pulled towards the center of the rail, thereby releasing the dropside from a locked position.

In accordance with a preferred embodiment of the invention, the latch mechanism is double acting. A cable actuating member is provided for controlling the movement of the cable. A locking member is provided for preventing movement of the cable actuating member. The locking member must be moved to an unlocked position in order to move the cable actuating member.

DETAILED DESCRIPTION OF THE INVENTION

Figure 1A:
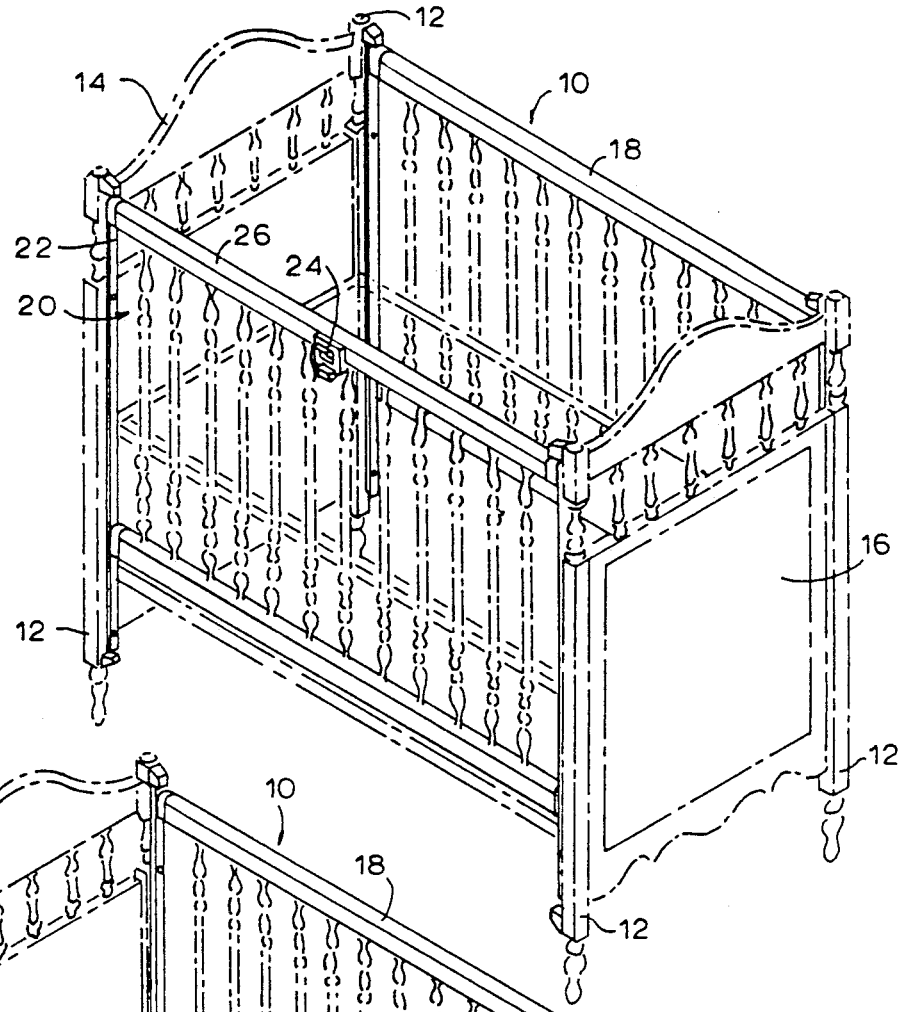
FIGS. 1A and 1B are perspective views illustrating a crib in accordance with the invention having a dropside in raised and lowered positions, respectively.
Figure 1B:
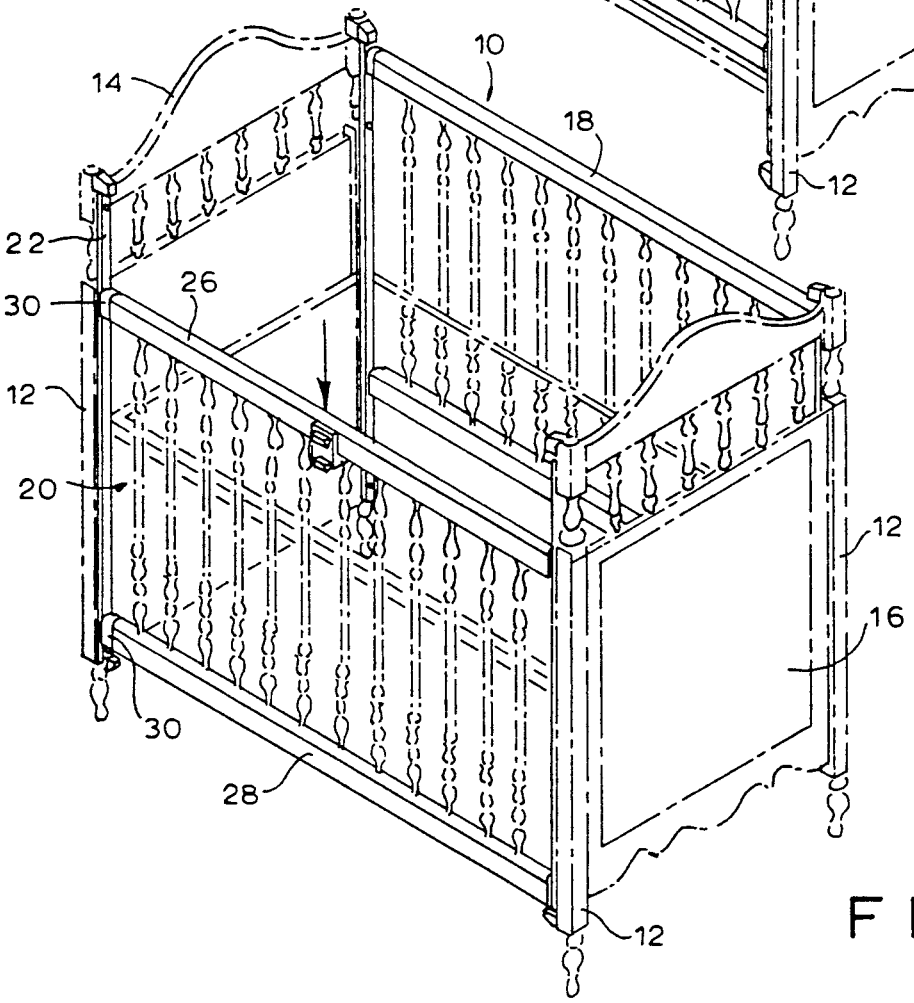

A crib 10 is shown in FIGS. 1A and 1B having four corner posts 12, a headboard 14, a footboard 16, a stationary side 18, and a dropside 20. The dropside is mounted to a pair of opposing, T-shaped tracks 22 which are, in turn, secured to two of the corner posts. The corner posts include grooved portions which receive portions of the tracks. A latch mechanism 24 is centrally mounted to the upper rail 26 of the dropside and allows it to be lowered to the position shown in FIG. 1B. Both the upper rail 26 and the lower rail 28 of the dropside 20 include plastic end fittings 30 having T-shaped slots 32 for engaging the tracks 22. The end fittings function as track followers.

Figure 2:
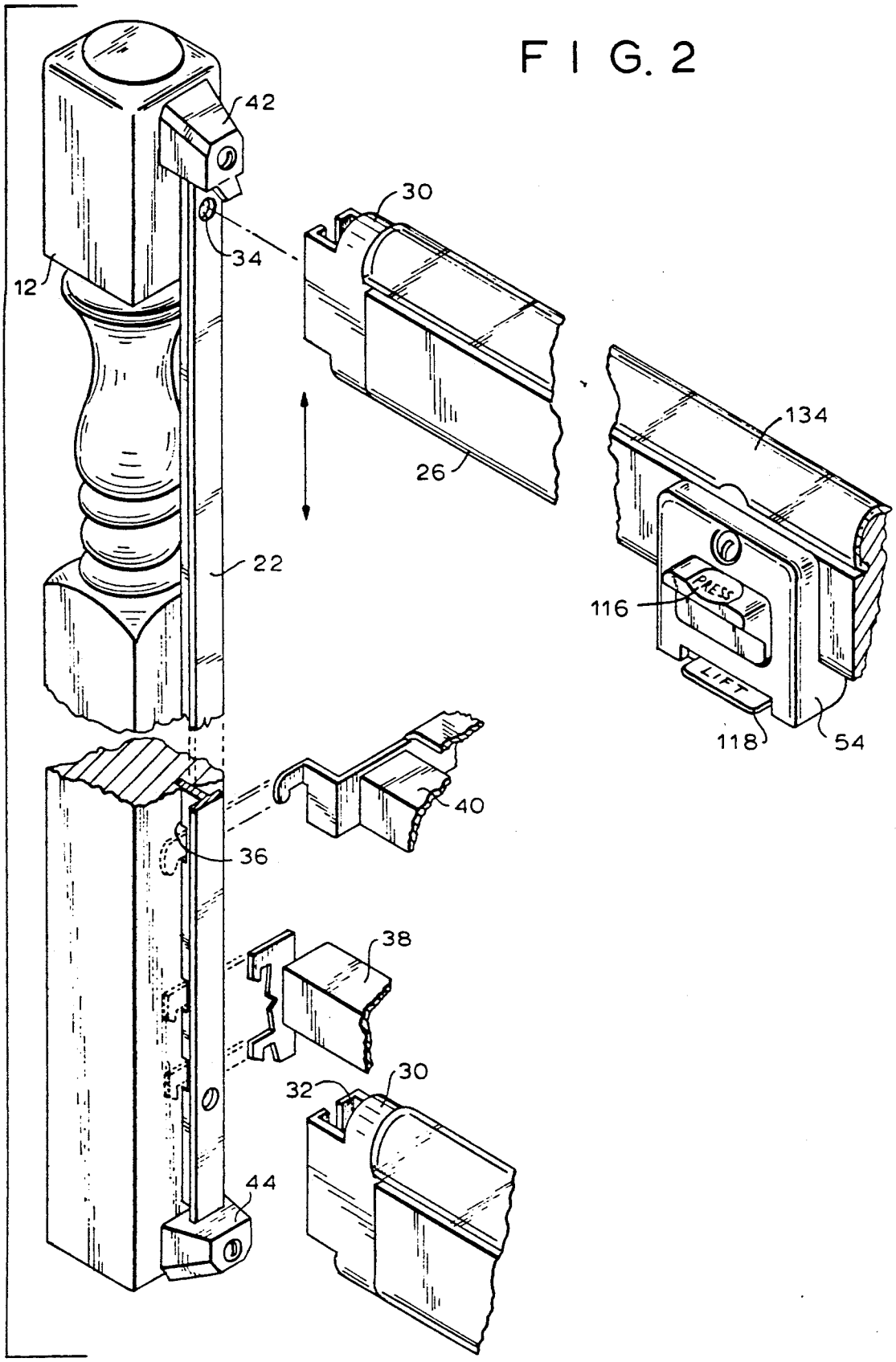
FIG. 2 is an enlarged perspective view illustrating the corner post of the crib and various crib components secured thereto.
Figure 3:
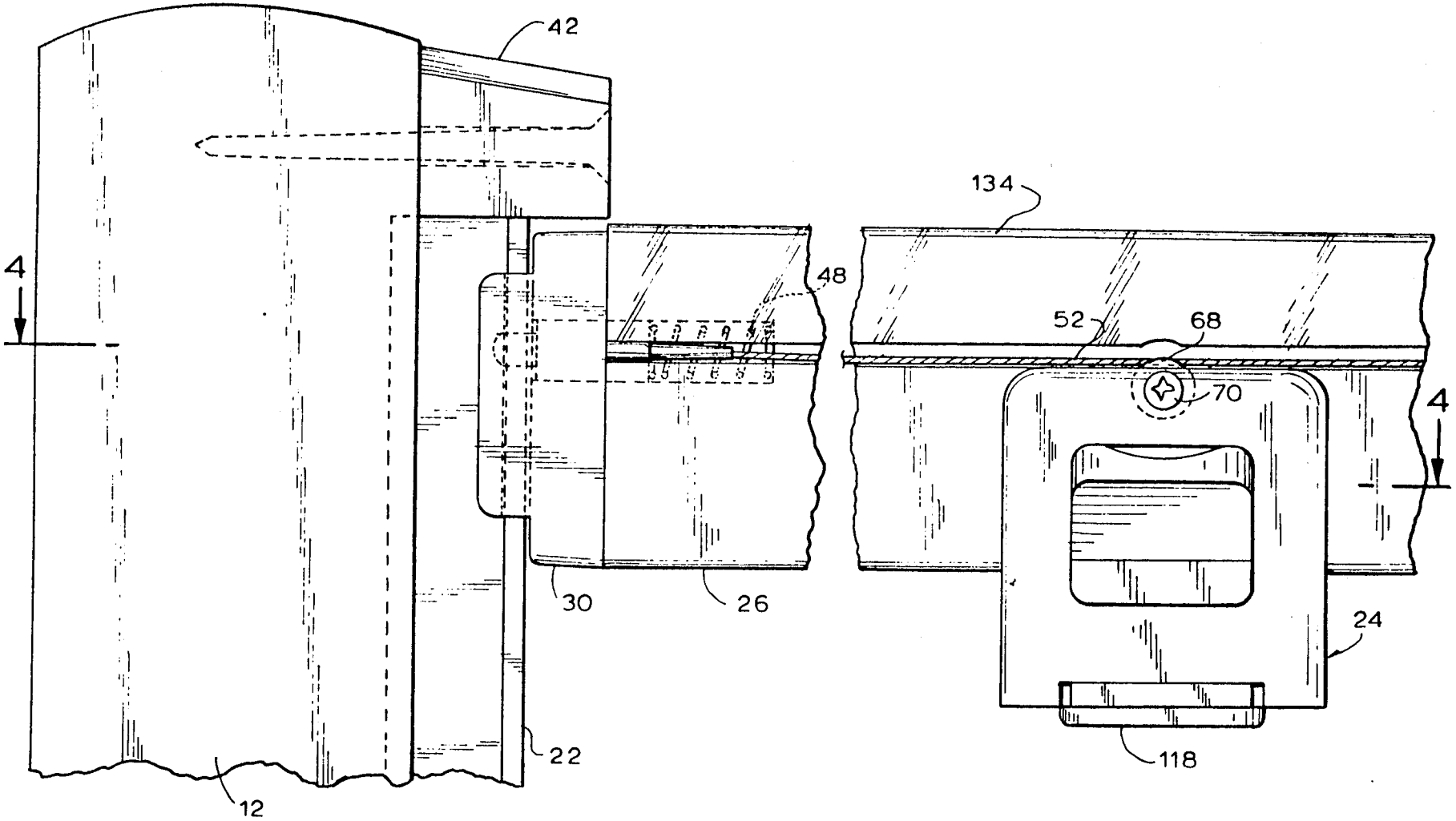
FIG. 3 is an enlarged, fragmentary front elevation view of the top rail of the dropside.
Figure 4:
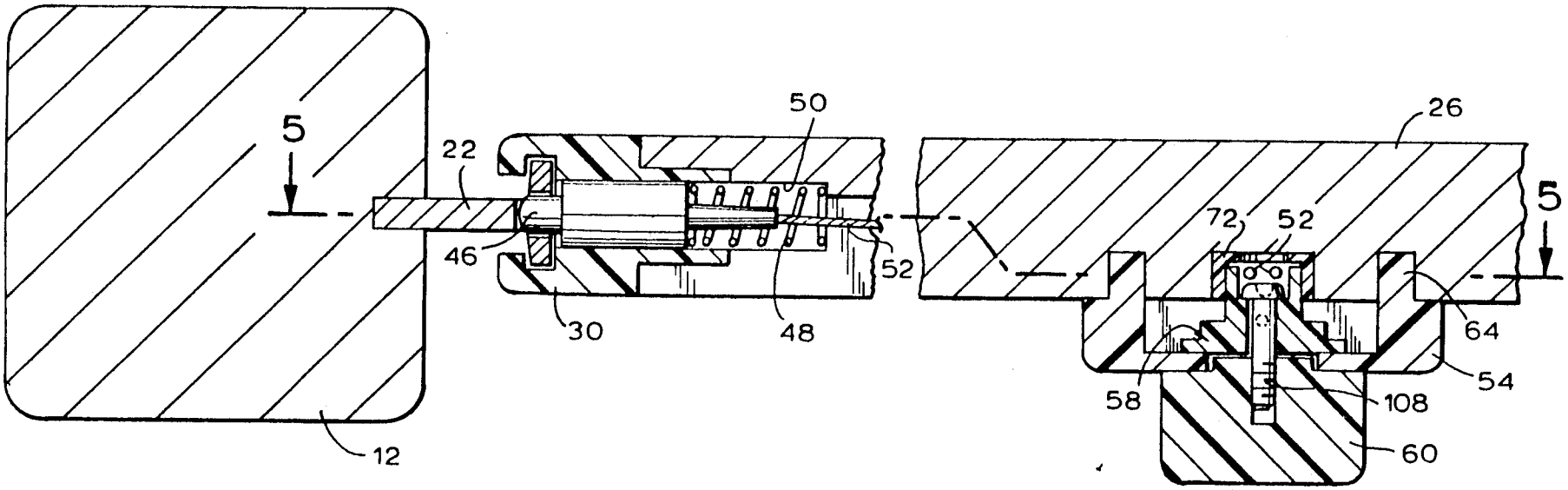
FIG. 4 is a sectional view thereof taken along the plane of line 4—4 in FIG. 3.
Figure 5:
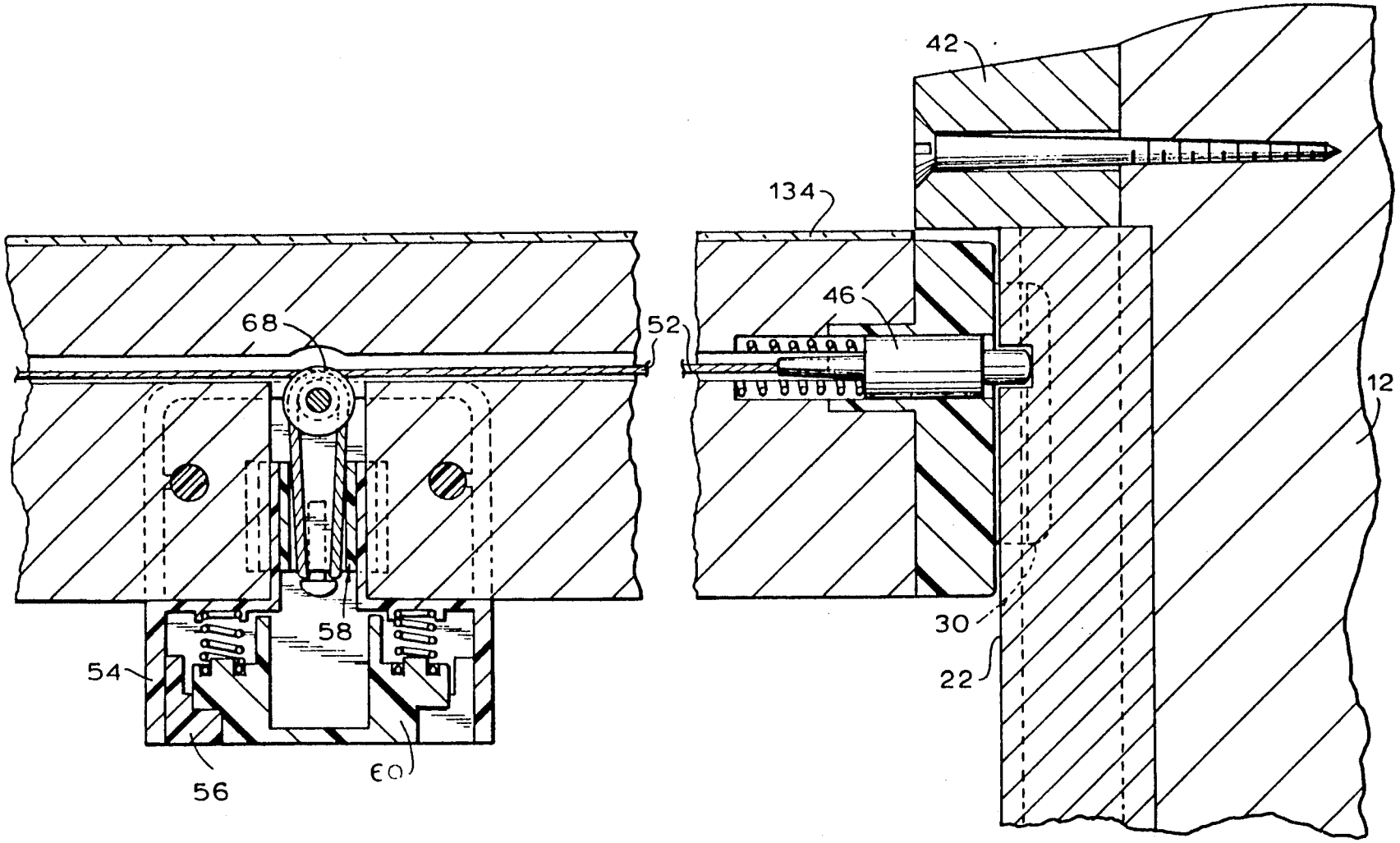
FIG. 5 is a sectional view thereof taken along the plane of line 5—5 in FIG. 4.

Referring to FIGS. 2–5, each track 22 includes at least one circular opening 34 for receiving a pin. The openings 34 within each opposing track are in opposing relation to each other. A set of slots 36 running perpendicularly to the pin openings are provided in the lower portions of the track. These slots permit the mounting of a pair of parallel stabilizer bars 38 and a mattress support 40, both of which include mounting projections as shown in FIG. 2. A pair of plastic stop members 42,44 are secured to the corner posts 12 near the ends of the tracks 22 to insure the dropside does not become disengaged therefrom. The dropside rests upon the lower stop members when in the down position. A pair of pins 46 extending from each end member 30 are positioned within the circular openings 34 when the dropside is in the up position. Each pin is spring-loaded by a coil spring 48 positioned within a cylindrical bore 50 in each end of the top rail 26. A wire cable 52 connects the pins 46 to the latch mechanism 24.

Figure 6:
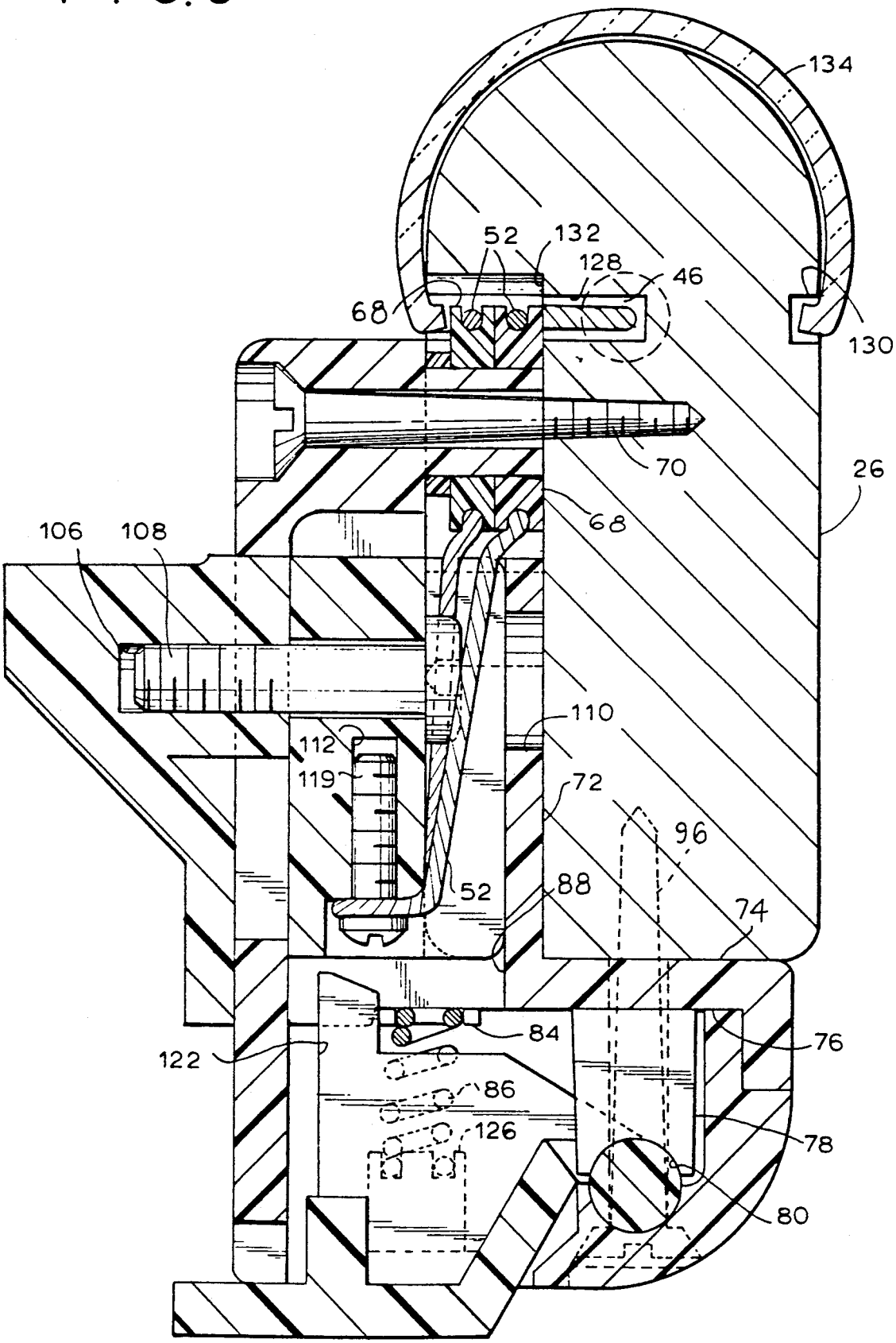
FIG. 6 is an enlarged sectional view of a latch mechanism in accordance with the invention.
Figure 7:
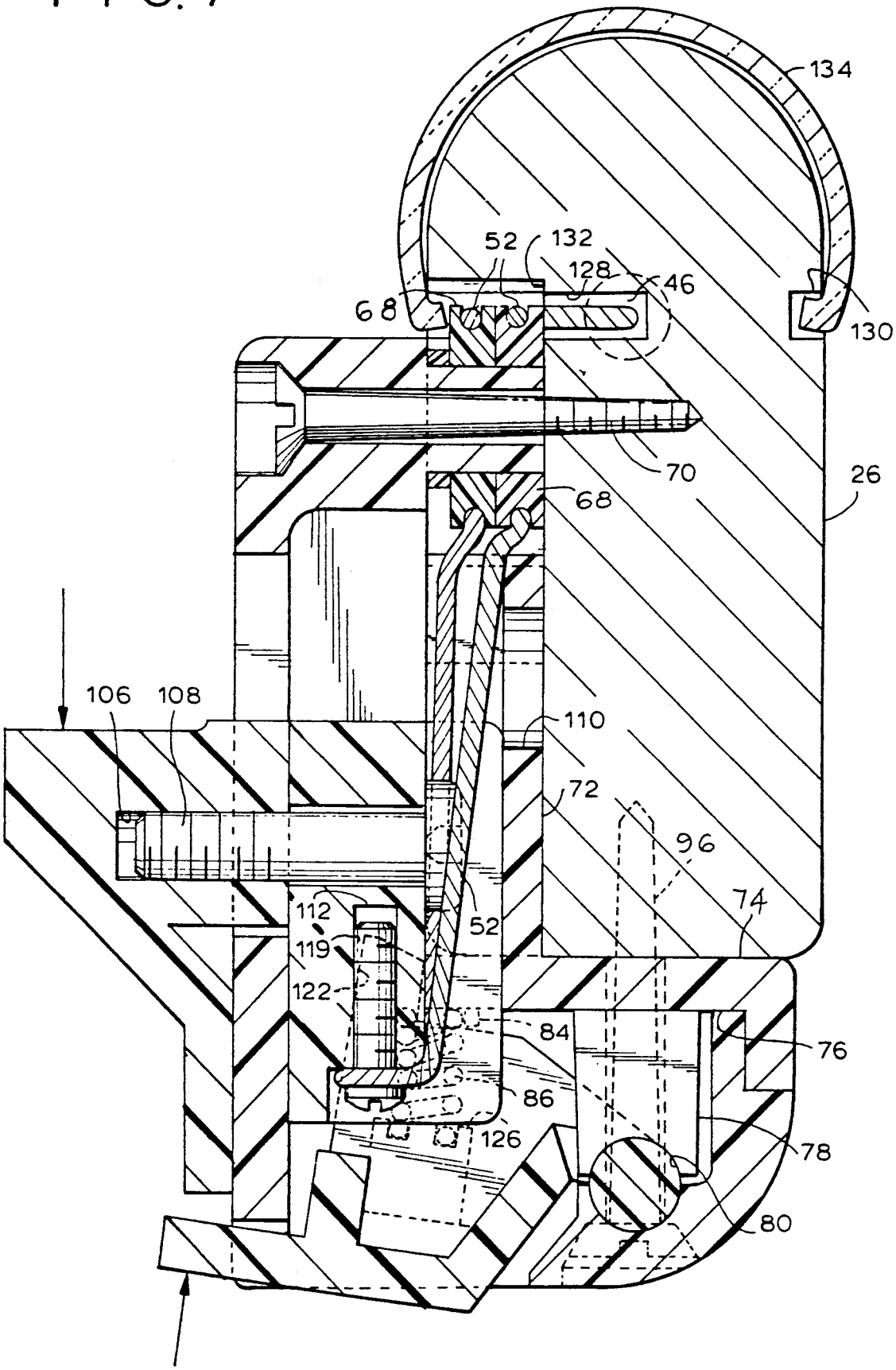
FIG. 7 is the same view as FIG. 6 illustrating the actuation of the latch mechanism.
Figure 8:
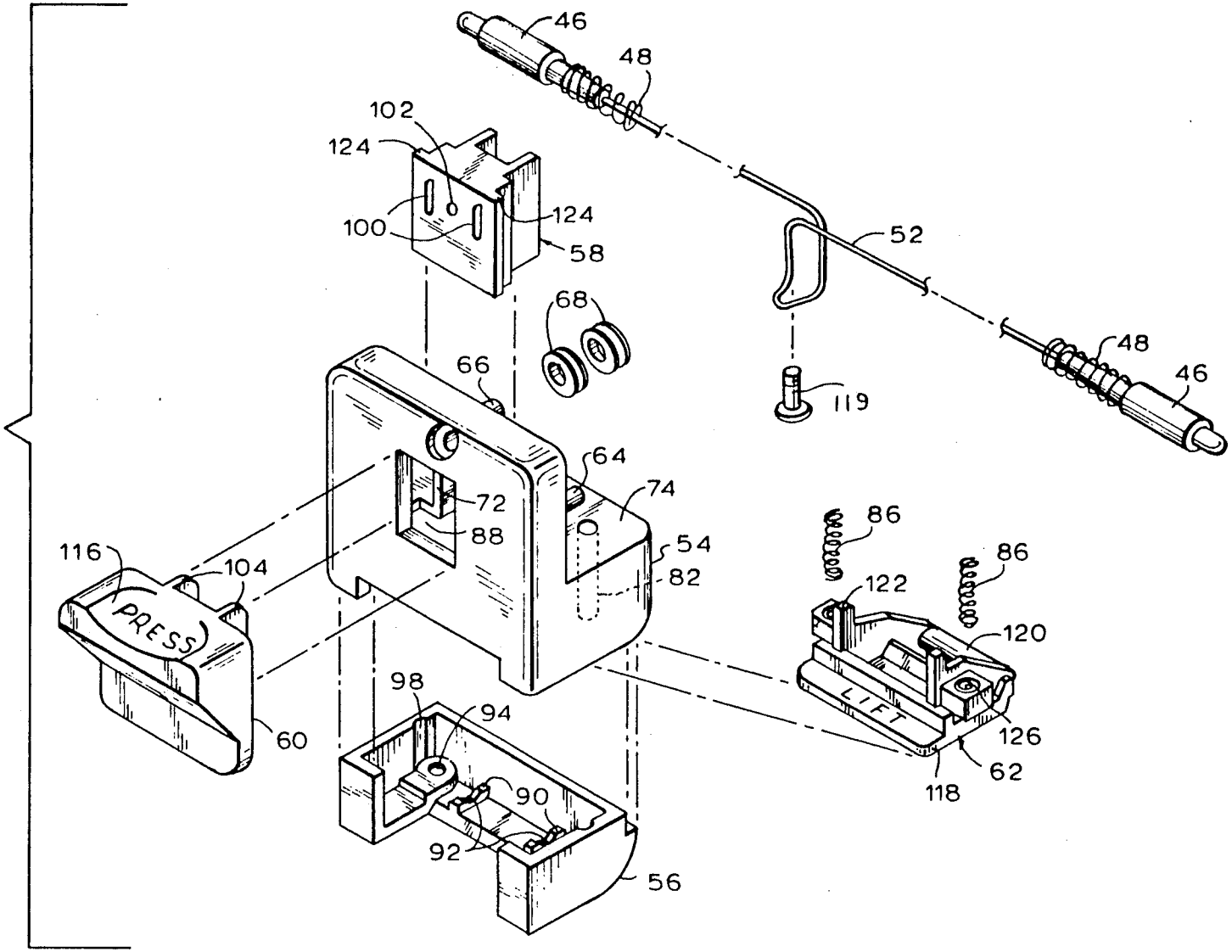
FIG. 8 is an exploded, perspective view of the latch mechanism.

The latch mechanism 24 is best shown in FIGS. 6–8. It includes an upper housing 54, a lower housing 56, a slide 58, a slide actuating member 60, and a slide locking member 62. The upper housing is generally L-shaped and fits about the front and lower sides of the upper dropside rail 26. It includes a pair of cylindrical projections 64 which fit within a pair of corresponding holes in the rail 26. A third inwardly extending, cylindrical projection 66 supports a pair of pulleys 68. A screw 70 extends through this projection and secures this housing 54 to the top rail 26.

A U-shaped projection 72 extends upwardly from the upper surface 74 of the upper housing 54. This projection and the inside surface of the front wall of the upper housing define a slideway in which the slide 58 is positioned. The bottom surface 76 of the upper housing 54 includes a pair of downwardly extending projections 78, each of said projections including a semicircular notch 80. A second pair of projections 82 are positioned between the respective notched projections 78 and the respective side walls of the upper housing 54. Each of the second pair of projections has a cylindrical construction. A pair of spring-retaining members 84 are also defined by the lower surface 76. The ends of a pair of coil springs 86 are respectively positioned within these members 84. A T-shaped opening 88 is defined in the upper housing 54 to allow the slide locking member 62 to engage the slide 58.

The lower housing 56 includes a pair of projections 90 extending from its upper surface, the projections each including a semicircular notch 92, these notches being in opposing relation to the notches 80 within projections 78. A pair of openings 94 are aligned with the shafts defined by projections 82. The lower housing is secured to the upper housing and the upper rail 26 by a pair of screws 96 extending through these openings 94 and the shafts. The side walls of the lower housing each include an arcuate groove 98 which guide the projections 82 into proper position.

The slide 58 is positioned within the slideway defined by the U-shaped projection 72 and the front wall of the upper housing 54. A pair of slots 100 and a threaded opening 102 are defined within the slide. The slide actuating member 60 includes a pair of rearwardly extending projections 104 which fit within the slots 100 and a threaded hole 106 aligned with the threaded opening 102. A screw 108 connects the slide actuating member 60 to the slide 58. An opening 110 within projection 72 provides access to the screw. A threaded shaft 112 extends upwardly from the bottom surface of the slide and a screw 114 is positioned therein. The center of the flexible wire cable 52, which preferably includes a polymeric sheathing, is secured to the slide by means of this screw 114. By pressing upon the upper, indented surface 116 of slide actuating member, tension may accordingly be exerted on the cable.

The slide locking member includes a lever 118, a cylindrical pivot member 120, and a pair of upwardly extending projections 122. The pivot member 120 is retained by the opposing semicircular notches within the projections 78,90 of the upper and lower housings. The projections 122 are normally positioned in opposing relation to the lateral extensions 124 of the front wall of the slide 58. When pivoted clockwise, the projections move past these lateral extensions and no longer restrict downward movement of the slide. A pair of spring-retaining members 126 are positioned in opposing relation to corresponding members 84 of the upper housing. The coil spring 86 accordingly urges the slide locking member 62 counterclockwise.

The top rail 26 includes a pair of grooves 128,130 defined within the front and rear surfaces thereof, respectively. The groove 128 extending within the front surface is considerably deeper than that within the rear surface. A vertical slot 132 extends from the bottom surface of the top rail 26 and intersects the horizontal groove 128. The slot 132 is centrally located with respect to the ends of the rail. The U-shaped projection 72 adjoins the walls of the rail 26 which define the slot 132. The wire cable 52 extends about the pulleys 68 and proceeds in opposite directions through the groove 128 to the respective ends of the top rail 26 where its ends are connected to the pins 46. A plastic teething rail 134 is secured to the top of the top rail 26 by means of the two grooves 128,130 therein.

The dropside is movable between upper and lower positions as the track followers 30 move along the opposing T-shaped tracks 22. The spring-loaded pins 46 are urged towards the tracks and will automatically move into the pin openings 34 when aligned therewith. In order to disengage the pins 46 from the tracks 22, the double-acting latch mechanism 24 is employed.

The slide actuating member 60 is substantially immovable unless the lever 118 of the slide locking member 62 is first lifted. By lifting the lever, the slide locking member pivots clockwise about the pivot member 120 moving the upwardly extending projections 122 thereof behind the lateral extensions 124 of the slide. This allows the slide actuating member, and therefore the slide 58 to be moved downwardly. Tension is exerted on the wire cable 52 which pulls the pins 46 from pin openings 34. In actual operation, the slide actuating member 60 and the lever 118 are moved towards each other simultaneously with the thumb and forefinger, respectively. Upon release of these members, springs 86 urge the slide locking member 62 counterclockwise back to its original position. Springs 48 urge the pins 46 towards the track 22. When the pins move within openings 34, the slide actuating member and slide are accordingly urged towards their original position as the cable pulls the slide upwardly.

What is claimed is:

1. A crib comprising:

first and second corner posts;

first and second tracks mounted to said first and second corner posts, respectively;

a dropside slidably mounted to said tracks, said dropside including a top rail;

means for locking said dropside to said tracks at a selected vertical position;

a latch mechanism mounted to said dropside;

a horizontal groove extending within the front surface of said top rail;

a vertical slot extending within said front surface of said top rail, said vertical slot adjoining said horizontal groove, said latch mechanism extending at least partially within said vertical slot;

a cable extending through said horizontal groove and connected between said latch mechanism and said locking means; and said latch mechanism including means for moving said cable axially within said horizontal groove, thereby actuating or deactuating said locking means.

2. A crib as defined in claim 1 wherein said locking means including a pin secured to at least one end of said cable and an opening within at least one of said first and second tracks for receiving said pin.

3. A crib as defined in claim 2 including means for resiliently urging said pin towards said opening.

4. A crib as defined in claim 1 wherein said latch mechanism includes a housing; a slide positioned within said housing and slidable therein towards or away from said horizontal groove, said cable being secured to said slide; and means for pushing said slide away from said horizontal groove.

5. A crib as defined in claim 4 including a slide locking member for preventing said slide from being pushed away from said horizontal groove when said slide locking member is in a first position, and means for displacing said slide locking member to a second position such that is will not prevent said slide from being pushed away from said horizontal groove.

6. A crib as defined in claim 5 including means for resiliently urging said slide locking member towards said first position.

7. A crib as defined in claim 6 wherein said cable includes two ends, each of said cable ends including a pin secured thereto, said slide being attached to said cable between said two ends thereof.

8. A crib as defined in claim 7 wherein said pins extend, respectively, from each end of said top rail, and including spring means positioned within each end of said top rail for resiliently urging said respective pins towards said first and second tracks, respectively.

9. A crib as defined in claim 5 wherein said means for pushing said slide away from said horizontal groove includes a slide actuating member connected to said slide, said slide actuating member including an upper surface extending outwardly with respect to said latch mechanism housing and said front surface of said top rail, said slide locking member being pivotably mounted to said housing and including a lever extending substantially parallel to said upper surface of said slide actuating member, said top surface of said slide actuating member and said lever being sufficiently close to each other to allow a user to move said slide and pivotably move said slide locking member towards each other by exerting pressure in opposite directions thereon with a thumb and a forefinger.

10. A crib dropside comprising:

a top rail;

a double acting latch mechanism mounted to said top rail, said latch mechanism including a housing, a slide member slidably mounted within said housing, a slide actuating member connected to said slide and projecting therefrom, a slide locking member pivotably mounted within said housing, said slide locking member including means for preventing said slide member from sliding in at least one direction, said slide locking member including an actuating lever for allowing said slide locking member to be moved to a position wherein said slide locking member no longer prevents said slide member from sliding in said one direction;

a cable connected to said slide and extending through said top rail; and a dropside locking member secured to said cable;

said slide actuating member being positioned sufficiently close to said actuating lever to allow a user to move said slide member and slide locking member substantially simultaneously through the use of a thumb and forefinger.

* * * * *